US012799621B2

(12) United States Patent
Wang et al.

(10) Patent No.: US 12,799,621 B2
(45) Date of Patent: Nov. 17, 2026

(54) UNIFORM FLOW CONTROL AGITATION DEVICE FOR ELECTROPLATING

(71) Applicant: SINYANG SEMICONDUCTOR (SHANGHAI) TECHNOLOGY & INNOVATION CO., LTD., Shanghai (CN)

(72) Inventors: Steven He Wang, Shanghai (CN); Pengpeng Lin, Shanghai (CN); Zheng Wang, Shanghai (CN)

(73) Assignee: SINYANG SEMICONDUCTOR (SHANGHAI) TECHNOLOGY & INNOVATION CO., LTD., Shanghai (CN)

( * ) Notice: Subject to any disclaimer, the term of this patent is extended or adjusted under 35 U.S.C. 154(b) by 582 days.

(21) Appl. No.: 18/219,795

(22) Filed: Jul. 10, 2023

(65) Prior Publication Data

US 2024/0044037 A1 Feb. 8, 2024

(30) Foreign Application Priority Data

Aug. 3, 2022 (CN) ..... 202210925167.3

(51) Int. Cl.
*C25B 9/00* (2021.01)
*C25D 21/10* (2006.01)
*C25D 21/12* (2006.01)

(52) U.S. Cl.
CPC ..... *C25D 21/10* (2013.01); *C25D 21/12* (2013.01)

(58) Field of Classification Search
CPC ..... C25D 21/10; C25D 21/12; C25D 21/00; C25B 9/00
See application file for complete search history.

(56) References Cited

U.S. PATENT DOCUMENTS

2023/0092346 A1* 3/2023 Sharbono ..... C25D 5/022 205/123
2024/0183059 A1* 6/2024 Masuda ..... C25D 21/10

FOREIGN PATENT DOCUMENTS

| | | | |
|---|---|---|---|
| CN | 2384674 | Y | 6/2000 |
| CN | 112236550 | A | 1/2021 |
| CN | 112301409 | A | 2/2021 |
| CN | 113881998 | A | 1/2022 |
| JP | H09-310196 | A | 12/1997 |

* cited by examiner

*Primary Examiner* — Zulmariam Mendez
(74) *Attorney, Agent, or Firm* — Oliff PLC

(57) ABSTRACT

The present invention provides a uniform flow control agitation device for electroplating, which involves the rotation of one or two flow-uniformization plates within an electroplating tank. This design effectively eliminates fluctuations in the electroplating solution during the electroplating process, thereby preventing bubbles from forming on the surface of the wafer. Simultaneously, the rotation of the flow-uniformization plates promotes the movement of ions in the electroplating solution, resulting in greater uniformity in the electrodeposit coating on the wafer's surface.

13 Claims, 4 Drawing Sheets

UNIFORM FLOW CONTROL AGITATION DEVICE FOR ELECTROPLATING

FIELD OF THE INVENTION

The present invention relates to semiconductor fabrication, more specifically, to a uniform flow control agitation device for electroplating.

BACKGROUND OF THE INVENTION

Electroplating is a process of depositing a thin layer of other metals or alloys onto certain metal surfaces using electrolysis. This technique has been widely used in various fields, ranging from its initial use for aesthetic decoration purposes, such as forming a shiny film on the surface of containers, to its application in high-tech industries where it has become an indispensable technology.

In the semiconductor industry, electroplating is used to form metal coatings on wafers, including gold, copper, lead-tin alloy, and others. To achieve high-quality results, it is crucial that the surface of the wafer is free of bubbles when immersed in the electroplating solution. However, the input of the solution into the electroplating tank can cause fluctuations that create bubbles on the wafer surface, thereby compromising the electroplating quality.

Therefore, a device that can eliminate these fluctuations is urgently needed to ensure the high-quality electroplating of wafers.

SUMMARY OF THE INVENTION

The object of the present invention is to provide a uniform flow control agitation device for electroplating, which solves technical problems encountered in prior devices. The uniform flow control agitation device effectively eliminates fluctuations in the electroplating solution during the electroplating process, thereby preventing the formation of bubbles on the wafer's surface and ensuring a high-quality electroplated coating.

To achieve the above object, the present invention provides a uniform flow control agitation device for electroplating, which comprises: an electroplating tank, a horizontally arranged flow-uniformization plate in the electroplating tank, and a driving unit that can rotate the flow-uniformization plate in the electroplating tank. The rotation of the flow-uniformization plate can effectively eliminate the fluctuation of the electroplating solution during electroplating, thus preventing bubbles from forming on the wafer's surface. Additionally, the rotation of the flow-uniformization plate can also promote ion movement in the electroplating solution and increase the uniformity of the electrodeposit coating on the wafer's surface.

Further, in different embodiments, the uniform flow control agitation device for electroplating further comprises a driven assembly, which includes: a drive gear connected to the driving unit to receive the output motions; and a driven gear that is in meshing engagement with the drive gear and is coupled to the flow-uniformization plate.

Further, in different embodiments, the driving unit is a stepper motor with a driving output gear installed on its output shaft, and the driven assembly further includes a driving input gear and a transmission shaft, with the driving input gear and drive gear mounted on the transmission shaft; the driving output gear meshes with the driving input gear. In these embodiments, the output shaft of the stepper motor drives the transmission shaft through the driving output gear and the driving input gear, such a structural design allows the stepper motor and the transmission shaft to be arranged left and right, thus making the uniform flow control agitation device has a simpler structure and a smaller volume.

Further, in different embodiments, the flow-uniformization plate is provided with multiple flow-guiding regions, and each flow-guiding region has one or more flow-guiding openings in its length direction; and a first and second flow-guiding wall are formed on either side of each flow-guiding region, extending upward to guide the flow of the electroplating solution and further reduce fluctuation and bubble formation.

Further, in different embodiments, the height of the first flow-guiding wall and the second flow-guiding wall is between 6 mm and 8 mm, this height range allows the walls to provide the best guidance, with an optimal value of 7 mm.

Further, in different embodiments, the first flow-guiding wall and the second flow-guiding wall are inclined to effectively reduce the bubbles generated by back pressure when the flow-uniformization plate rotates and to reduce the dead zone in the central flow field of the wafer.

Further, in different embodiments, the angle between the first flow-guiding wall and the second flow-guiding wall is between 38° and 42°, with an optimal value of 40°.

To achieve the above object, the present invention also provides a uniform flow control agitation device for electroplating, which comprises: an electroplating tank; a first and a second flow-uniformization plates horizontally arranged in the electroplating tank, with the first plate positioned directly above the second plate; a driving unit that can rotate the first and second flow-uniformization plates in the electroplating tank at different speeds, thereby eliminating electroplating solution fluctuations and preventing bubbles from forming on the wafer's surface. The rotation of the plates also promotes ion movement in the electroplating solution, resulting in a more uniform electrodeposit coating on the wafer.

Further, in different embodiments, the driving unit can rotate the plates in opposite directions. It is worth noting that when the first and second flow-uniformization plates rotate in opposite directions, they are considered to have a rotation speed difference regardless of the absolute values of their rotation speeds.

Further, in different embodiments, the driving unit can rotate the first and second flow-uniformization plates in the same direction but at different rotation speeds.

Further, in different embodiments, the driving unit can rotate the plates at a fixed speed difference throughout the electroplating process to maintain a stable electroplating solution and reduce bubble formation.

Further, in different embodiments, the uniform flow control agitation device for electroplating further comprises a control unit that adjusts the rotation speed difference between the plates according to the electroplating thickness of the wafer. This design can better meet the plating requirements and improve the plating quality.

Further, in different embodiments, the driving unit includes a driving source, such as a stepper motor, that simultaneously rotates the first and second flow-uniformization plates.

Further, in different embodiments, the uniform flow control agitation device for electroplating further comprises a driven assembly, which includes: a transmission shaft connected to the driving unit to receive the output motions; a first drive gear and a second drive gear set on the transmission shaft, with the first drive gear meshing with a tumbler gear; a first driven gear in meshing engagement with the tumbler gear and coupled to the first flow-uniformization plate; and a second driven gear in meshing engagement with the second drive gear and coupled to the second flow-uniformization plate.

Further, in different embodiments, the driving unit is a stepper motor with a driving output gear installed on its output shaft; and the driven assembly further includes a driving input gear set on the transmission shaft, with the driving output gear meshing with the driving input gear. Such a design allows the stepper motor and the transmission shaft to be arranged left and right, which simplifies the structure and reduces the volume of the uniform flow control agitation device.

Further, in different embodiments, the driving unit comprises a first driving source and a second driving source, which respectively rotate the first and second flow-uniformization plates. The driving sources can be stepper motors, servo motors, cylinders, or other types of motors, and they can drive the plates directly or indirectly. If the plates are indirectly driven, this can be accomplished through gear-driven assemblies, cam ejector driven assemblies, crankshaft driven assemblies, and other mechanisms.

Further, in different embodiments, the first flow-uniformization plate is provided with multiple flow-guiding regions, each flow-guiding region has one or more flow-guiding openings in its length direction; both sides of each flow-guiding region extend upward to form a first flow-guiding wall and a second flow-guiding wall. The flow-guiding walls can guide the flow of the electroplating solution, so as to further reduce the fluctuation of the electroplating solution, and avoid bubbles on the surface of the wafer.

Further, in different embodiments, the height of the first flow-guiding wall and the second flow-guiding wall is between 6 mm and 8 mm, which allows the flow-guiding walls to play the best guiding role, with 7 mm being the optimal value.

Further, in different embodiments, the first flow-guiding wall and the second flow-guiding wall are inclined, such design can effectively reduce the bubbles generated by the back pressure when the flow-uniformization plate rotates, and reduce the dead zone of the central flow field of the wafer.

Further, in different embodiments, the angle between the first flow-guiding wall and the second flow-guiding wall is between 38° and 42°, with an optimal value of 40°.

Further, in different embodiments, the second flow-uniformization plate is provided with multiple radially distributed flow-guiding openings.

Further, in different embodiments, the first and second flow-uniformization plates have a circular shape, with their rotation centers located on a vertical axis. This circular design reduces resistance when the plates rotate in the electroplating solution, effectively eliminating solution fluctuation and preventing bubbles from forming on the wafer's surface, as compared to other plate shapes.

Compared to the prior art, the present invention has the following beneficial effects:

The present invention provides a uniform flow control agitation device for electroplating, which involves the rotation of one or two flow-uniformization plates within an electroplating tank. This design effectively eliminates fluctuations in the electroplating solution during the electroplating process, thereby preventing bubbles from forming on the surface of the wafer. Simultaneously, the rotation of the flow-uniformization plates promotes the movement of ions in the electroplating solution, resulting in greater uniformity in the electrodeposit coating on the wafer's surface.

BRIEF DESCRIPTION OF THE DRAWINGS

Various exemplary embodiments are described herein by way of example in conjunction with the following Figures, wherein.

REFERENCE NUMERALS IN THE DRAWINGS

Figure 1:
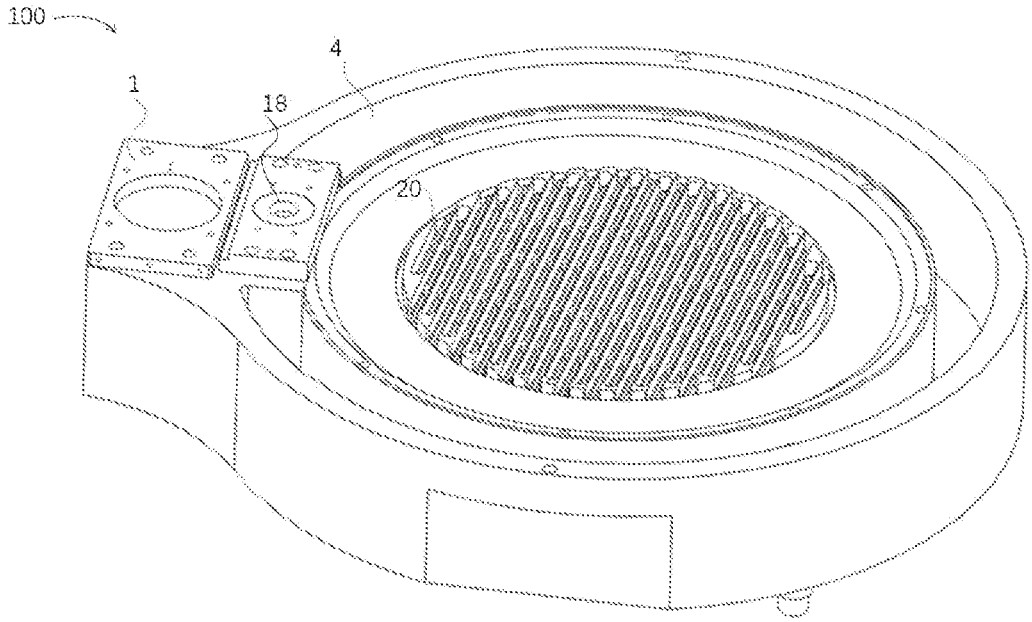
FIG. 1 is a structural schematic view of the uniform flow control agitation device for electroplating in the embodiment 1 of the present invention.

100 uniform flow control agitation device for electroplating; 1 driving unit;
2 first flow-uniformization plate; 3 second flow-uniformization plate;
4 electroplating tank; 5 transmission shaft; 6 tumbler gear;
7 first drive gear; 8 second drive gear;
9 first driven gear; 10 second driven gear; 11 first flow-guiding region;
12 second flow-guiding region; 13 third flow-guiding region;
14 first flow-guiding wall; 15 second flow-guiding wall; 16 flow-guiding opening
18 driven assembly; 20 flow-uniformization plate; 31 drive gear; 32 driven gear

DETAILED DESCRIPTION OF THE PREFERRED EMBODIMENTS

The present invention will be described more fully for those skilled in the art hereinafter with reference to the accompanying drawings by introducing some of the preferable embodiments of the present invention, for the purpose of clarity and better understanding of the techniques. This invention may be embodied in various different forms and the invention should not be construed as being limited to the embodiments set forth herein.

In the description, elements with identical structures are marked with the same reference numerals, and like elements with similar structure or function are marked to throughout with like reference numerals, respectively. The dimension and thickness of each of the elements in the accompanying drawings are arbitrarily shown, and the invention does not define the dimension and thickness of each element. Certain elements may be shown somewhat exaggerated in thickness in the interest of clarity.

Directional relative terms mentioned in the present invention, such as "upper", "lower", "front", "back", "left", "right", "inside", "outside", "side", and the like, are only directions by referring to the accompanying drawings, and are merely used to explain and describe the present invention, but the present invention is not limited thereto.

It will be understood that when an element is referred to as being "on/above" another element, it can be directly placed on the other element, or there may be an intermediate element on which it is placed, and the intermediate element is placed on the other element. When an element is referred to as being "mounted to" or "connected to" another element, either one can be understood as being directly "mounted" or "connected", or via an intermediate element to be indirectly "mounted to" or "connected to" the other element.

Embodiment 1

As shown in FIGS. 1-4, the present embodiment provides a uniform flow control agitation device for electroplating 100, which includes an electroplating tank 4, a flow-uniformization plate 20, a driving unit 1 and a driven assembly 18. The flow-uniformization plate 20 is horizontally positioned in the electroplating tank 4, and the driving unit 1 can rotate the flow-uniformization plate 20 in the electroplating tank 4. This rotation eliminates fluctuations in the electroplating solution and prevents bubble formation on the wafer's surface. Additionally, the rotation promotes ion movement in the solution and enhances the coating uniformity on the wafer's surface.

The rotation speed of the flow-uniformization plate 20 in the electroplating tank 4 can be designed in a fixed mode, that is, the flow-uniformization plate 20 always rotates at the same speed under the drive of the driving unit 1, so that the electroplating solution can maintain a stable state throughout the plating process, further reducing the possibility of bubbles generation. Of course, users can also design the rotation speed of the flow-uniformization plate 20 in the electroplating tank 4 as an adjustable mode according to actual needs. Specifically, a control unit can be set up, which can adjust the rotation speed of the flow-uniformization plate 20 based on the plating thickness of the wafer, thereby better meeting the actual plating requirements and improve the plating quality.

Figure 2:
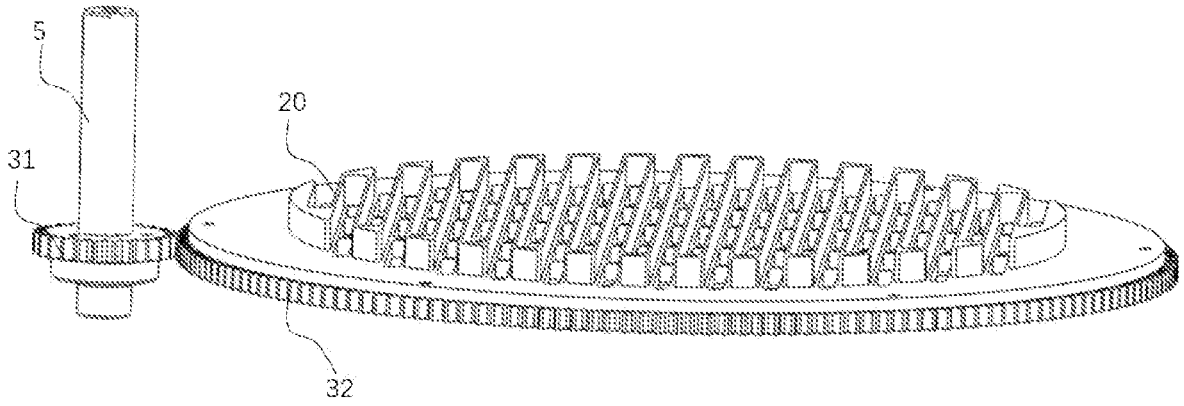
FIG. 2 is a structural schematic view of the part of the driven assembly and the flow-uniformization plate in the embodiment 1 of the present invention.

In the present embodiment, the driving unit 1 rotates the flow-uniformization plate 20 in the electroplating tank 4 through the driven assembly 18. Specifically, as shown in FIG. 2, the driven assembly 18 includes a transmission shaft 5, a drive gear 31, a driven gear 32 and a driving input gear. The driving input gear and the drive gear 31 are set on the transmission shaft 5, and the driven gear 32 meshes with the drive gear 31 and is coupled to the flow-uniformization plate 20. The driving unit 1 is a stepper motor with a driving output gear installed on its output shaft, the driving output gear is in meshing engagement with the driving input gear.

When the output shaft of the stepper motor rotates, it drives the driving output gear to rotate, which in turn drives the driving input gear. The driving input gear then drives the transmission shaft 5 to rotate, which further rotates the drive gear 31. The driven gear 32 meshes with the drive gear 31 and receives its motions, thus driving the rotation of the flow-uniformization plate 20.

Figure 3:
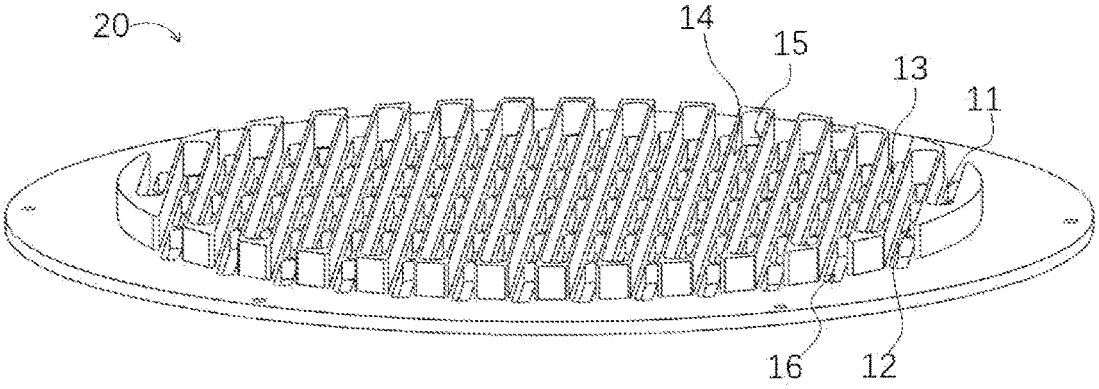
FIG. 3 is a structural schematic view of the flow-uniformization plate in the embodiment 1 of the present invention.

As shown in FIG. 3, the shape of the flow-uniformization plate 20 is circular, which encounters less resistance when rotating in the electroplating solution compared to plates of other shapes. This reduces fluctuations in the electroplating solution and helps to prevent bubbles from forming on the surface of the wafer. Additionally, a plurality of flow-guiding openings 16 are well distributed on the flow-uniformization plate 20, with the openings being arranged in an array or concentric circles, or distributed radially.

As shown in FIG. 3, the flow-uniformization plate 20 is uniformly equipped with several equally wide strip-shaped flow-guiding regions from left to right, such as the first flow-guiding region 11, the second flow-guiding region 12, and the third flow-guiding region 13 shown in the figure. A plurality of flow-guiding openings 16 are uniformly set along the length direction of each flow-guiding region, and both sides of each flow-guiding region extend upward to form a first flow-guiding wall 14 and a second flow-guiding wall 15. The flow-guiding walls can guide the flow of the electroplating solution, so as to further reduce the fluctuation of the electroplating solution, and avoid bubbles on the surface of the wafer.

Figure 4:
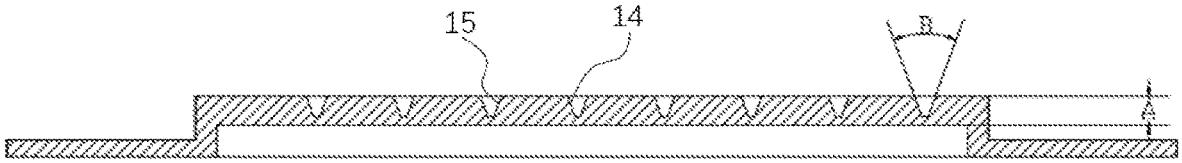
FIG. 4 is a sectional structural schematic view of the flow-uniformization plate in the embodiment 1 of the present invention.

Furthermore, as shown in FIG. 4, both the first flow-guiding wall 14 and the second flow-guiding wall 15 are inclined and have the same inclination angle. The included angle B between the first and second flow-guiding walls 14,15 is between 38° and 42°, with a preferred value of 40°. With this design, the first and second flow-guiding walls 14,15 can effectively reduce the bubbles generated by the back pressure when the flow-uniformization plate 20 rotates, and reduce the dead zone of the central flow field of the wafer. In addition, the height A of both the first and second flow-guiding walls 14,15 is between 6 mm and 8 mm, with a preferred value of 7 mm. The height design of the first and second flow-guiding walls 14,15 can achieve the best flow-guiding effect and avoid fluctuations on the surface of the electroplating solution.

Embodiment 2

As shown in FIGS. 5-9, the present embodiment provides a uniform flow control agitation device 100, the structure of which is generally the same as that of the uniform flow control agitation device 100 provided in the first embodiment. The difference is that in the first embodiment, only one flow-uniformization plate is provided, while in the present embodiment, an additional flow-uniformization plate is added based on the first embodiment.

Figure 5:
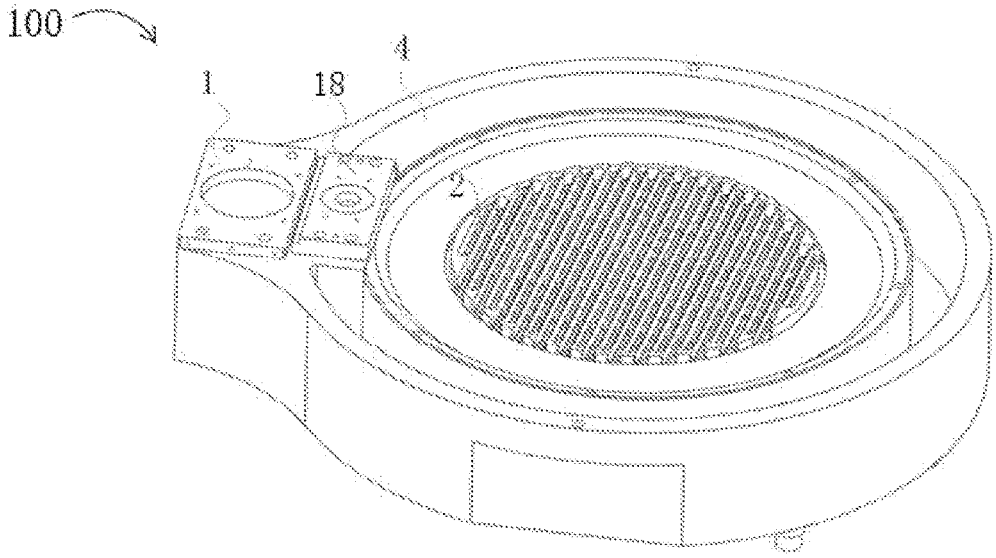
FIG. 5 is a structural schematic view of the uniform flow control agitation device for electroplating in the embodiment 2 of the present invention.

Specifically, as shown in FIG. 5, this embodiment provides a uniform flow control agitation device for electroplating 100 that includes an electroplating tank 4, a first flow-uniformization plate 2, a second flow-uniformization plate 3, a driving unit 1 and a driven assembly 18.

The first and second flow-uniformization plates 2,3 are horizontally arranged in the electroplating tank 4, with the first plate 2 positioned directly above the second plate 3, and the driving unit 1 can rotate the plates 2,3 in the electroplating tank 4 at different speeds. This design can effectively reduce fluctuations in the electroplating solution during electroplating and prevent bubbles from forming on the surface of the wafer. Moreover, the rotation of the plates 2,3 can also promote ion movement in the electroplating solution and enhance the uniformity of the electrodeposit coating on the wafer's surface.

The first flow-uniformization plate 2 and the second flow-uniformization plate 3 can have a rotation speed difference by either of the following two ways: first, the two plates 2,3 rotate in the same direction, but their rotation speeds are different, thus creating a relative rotation speed difference; second, the two plates 2,3 rotate in opposite directions, and in this case, they also have a relative rotation speed difference due to the direction of the rotation speed, regardless of whether the absolute values of their rotation speeds are the same or not.

Furthermore, the rotation speed difference between the first flow-uniformization plate 2 and the second flow-uniformization plate 3 in the electroplating tank 4 can be designed to be in a fixed mode, where the first and the second flow-uniformization plates 2,3 always rotate at the same speed difference under the drive of the driving unit 1, thus maintaining a stable state of the electroplating solution throughout the electroplating process and further reducing the possibility of bubble generation.

Of course, users can also design the rotation speed difference between the first flow-uniformization plate 2 and the second flow-uniformization plate 3 in the electroplating tank 4 to be adjustable. Specifically, a control unit can be set up to adjust the rotation speed difference of the first and the second flow-uniformization plates 2,3 based on the electroplating thickness of the wafer, which can better meet the actual electroplating needs and improve the plating quality.

The driving unit 1 can include a driving source that simultaneously drives the first flow-uniformization plate 2 and the second flow-uniformization plate 3 to rotate through transmission components such as gears. Using the same driving source to drive the rotation of the first and second flow-uniformization plates 2,3 can simplify the structure of the device. Of course, to facilitate the adjustment of the rotation speed and direction of the first and second flow-uniformization plates 2,3, users can also set up two driving sources to drive them separately.

As a preferred embodiment, the driving unit 1 includes only one driving source, which drives the first flow-uniformization plate 2 and the second flow-uniformization plate 3 to rotate at a fixed speed difference in opposite directions through the driven assembly 18. Specifically, the driving unit 1 is a stepper motor, and a driving output gear is provided on the output shaft of the stepper motor.

Figure 6:
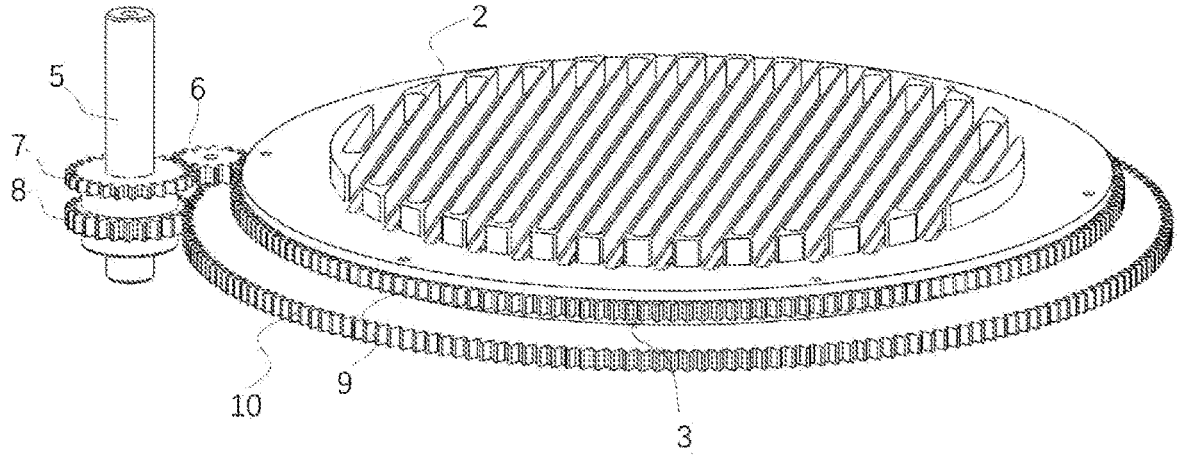
FIG. 6 is a structural schematic view of the part of the driven assembly and the flow-uniformization plates in the embodiment 2 of the present invention.

As shown in FIG. 6, the driven assembly 18 includes a transmission shaft 5, a first drive gear 7, a second drive gear 8, a driving input gear, a tumbler gear 6, a first driven gear 9, and a second driven gear 10. Among them, the driving input gear, the first drive gear 7, and the second drive gear 8 are sequentially mounted on the transmission shaft 5 from top to bottom. The driving input gear engages with the driving output gear provided on the output shaft of the stepper motor, so that the stepper motor can drive the transmission shaft 5 to rotate through the driving output gear and the driving input gear. The rotation of the transmission shaft 5 then drives the first drive gear 7 and the second drive gear 8 mounted thereon to rotate.

The first drive gear 7 engages with the tumbler gear 6, the tumbler gear 6 engages with the first driven gear 9, and the first driven gear 9 is coupled to the first flow-uniformization plate 2. The second drive gear 8 engages with the second driven gear 10, and the second driven gear 10 is coupled to the second flow-uniformization plate 3.

With the above design, when the first drive gear 7 and the second drive gear 8 rotate under the driving of the transmission shaft 5, the second drive gear 8 drives the second driven gear 10 engaged with it to rotate, and the second driven gear 10 further drives the second flow-uniformization plate 3 to rotate. At the same time, the first drive gear 7 drives the tumbler gear 6 engaged with it to rotate, and the tumbler gear 6 changes the rotation direction of the output of the transmission shaft 5, causing the first driven gear 9 engaged with it to rotate in the direction opposite to the rotation direction of the second driven gear 10. The first driven gear 9 then further drives the first flow-uniformization plate 2 to rotate. Therefore, the first flow-uniformization plate 2 and the second flow-uniformization plate 3 rotate in opposite directions at a fixed speed difference.

The rotation speed difference between the first flow-uniformization plate 2 and the second flow-uniformization plate 3 can be adjusted by changing the number of teeth or the diameter of the tumbler gear 6.

Further, regarding the structural design of the first flow-uniformization plate 2 and the second flow-uniformization plate 3, as shown in FIG. 6, both are circular flow-uniformization plates. Compared with flow-uniformization plates of other shapes, circular flow-uniformization plates encounter less resistance when rotating in the plating solution, which helps to eliminate the surface wave generated on the plating solution and avoid bubbles on the wafer's surface to be plated. In addition, the rotation centers of the first flow-uniformization plate 2 and the second flow-uniformization plate 3 are on the same vertical axis, which makes the plating solution between them more stable, reducing the generation of bubbles.

Furthermore, a plurality of flow-uniformization openings 16 are uniformly arranged on both the first and second flow-uniformization plates 2,3. The term "uniformly arranged" refers to the flow-uniformization openings 16 arranged in an array, concentric circles, or radical distribution. The uniform arrangement of flow-uniformization openings 16 helps to increase the uniformity of the plating solution.

Figure 7:
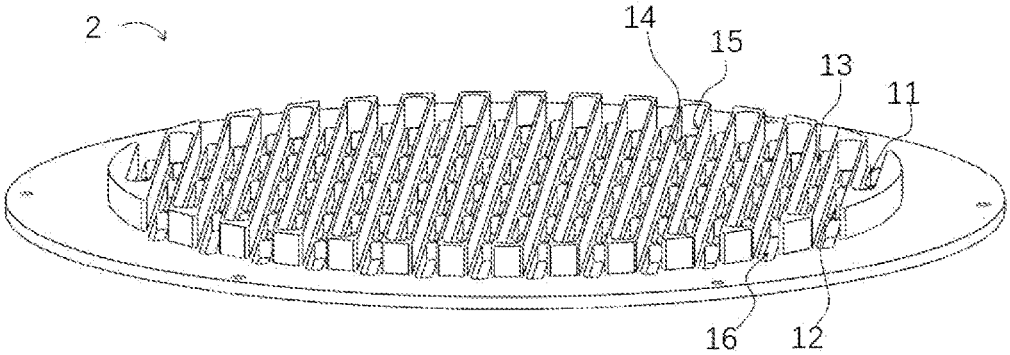
FIG. 7 is a structural schematic view of the first flow-uniformization plate in the embodiment 2 of the present invention.

As a more preferred embodiment, the first flow-uniformization plate 2 of this embodiment adopts the same structural design as that of the flow-uniformization plate 20 described in the first embodiment, as shown in FIG. 7, the first flow-uniformization plate 2 is uniformly equipped with multiple equally wide strip-shaped flow-guiding regions from left to right, such as the first flow-guiding region 11, the second flow-guiding region 12, and the third flow-guiding region 13 shown in the figure. Multiple flow-guiding openings 16 are uniformly set along the length direction of each flow-guiding region, and both sides of each flow-guiding region extend upward to form a first flow-guiding wall 14 and a second flow-guiding wall 15. The flow-guiding walls can guide the flow of the electroplating solution, so as to further reduce the fluctuation of the electroplating solution, and avoid bubbles on the surface of the wafer.

Figure 8:
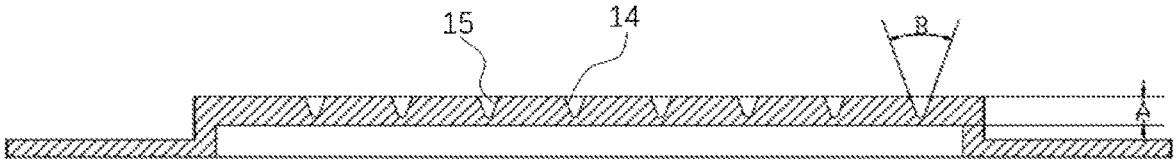
FIG. 8 is a sectional structural schematic view of the first flow-uniformization plate in the embodiment 2 of the present invention.

In addition, as shown in FIG. 8, both the first flow-guiding wall 14 and the second flow-guiding wall 15 are inclined and have the same inclination angle. The included angle B between the first and second flow-guiding walls is between 38° and 42°, with a preferred value of 40°. With this design, the first and second flow-guiding walls 14,15 can effectively reduce the bubbles generated by the back pressure when the first flow-uniformization plate 2 rotates, and reduce the dead zone of the central flow field of the wafer. In addition, the height A of both the first and second flow-guiding walls 14,15 is between 6 mm and 8 mm, with a preferred value of 7 mm. The height design of the first and second flow-guiding walls 14,15 can achieve the best flow-guiding effect and avoid fluctuations on the surface of the electroplating solution.

Figure 9:
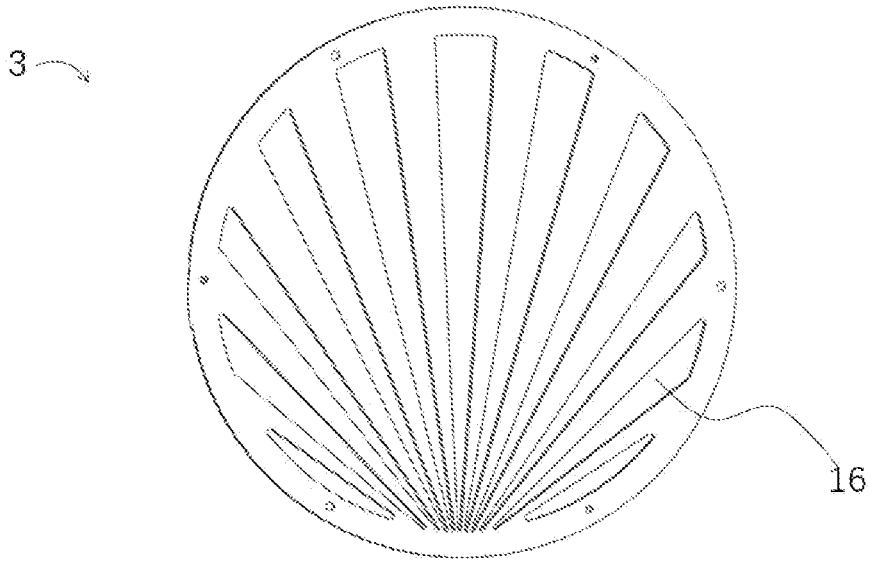
FIG. 9 is the first structural schematic view of the second flow-uniformization plate in the embodiment 2 of the present invention.
Figure 10:
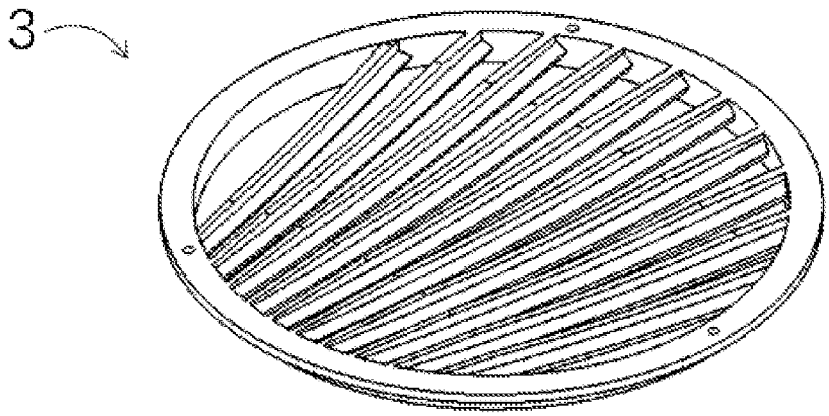
FIG. 10 is the second structural schematic view of the second flow-uniformization plate in other embodiment of the present invention.

Regarding the design of the second flow-uniformization plate 3, as shown in FIG. 9, multiple flow-guiding openings 16 are also provided on the second flow-uniformization plate 3 in a radial distribution. This design allows the plating solution to disperse more uniformly on the second flow-uniformization plate 3 after entering the electroplating tank 4. It is worth noting that the flow-uniformization openings 16 on both the first flow-uniformization plate 2 and the second flow-uniformization plate 3 can take various forms. 10 shows one possible structural design of the second flow-uniformization plate 3 that can be used in other embodiments.

The above are only the preferable embodiments of the present invention. Without departing from the principles of the present invention, persons skilled in the art can further make improvements and polishments to the above technical solutions. Such improvements and polishments shall be within the protection scope of the present invention. It is worth noting that the uniform flow control agitation device of the present invention can comprise one or two or more flow-uniformization plates.

The invention claimed is:

1. A uniform flow control agitation device for electroplating, comprising:

an electroplating tank;

a first and a second flow-uniformization plates horizontally arranged in the electroplating tank, with the first plate positioned directly above the second plate;

a driving unit that can rotate the first and second flow-uniformization plates in the electroplating tank at different speeds, wherein:

the driving unit includes a driving source that is configured to simultaneously rotate the first and the second flow-uniformization plates, the device further comprises a driven assembly, which includes:

a transmission shaft connected to the driving unit and configured to receive output motions;

a first drive gear and a second drive gear set on the transmission shaft, with the first drive gear meshing with a tumbler gear;

a first driven gear in meshing engagement with the tumbler gear and coupled to the first flow-uniformization plate; and a second driven gear in meshing engagement with the second drive gear and coupled to the second flow-uniformization plate.

2. The uniform flow control agitation device for electroplating according to claim 1, wherein the driving unit rotates the first and second flow-uniformization plates in opposite directions.

3. The uniform flow control agitation device for electroplating according to claim 1, wherein the driving unit rotates the first and second flow-uniformization plates in the same direction, but with different rotation speeds.

4. The uniform flow control agitation device for electroplating according to claim 1, wherein the driving unit rotates the first and second flow-uniformization plates at a fixed speed difference.

5. The uniform flow control agitation device for electroplating according to claim 1, wherein the device further comprises a control unit, which can adjust a rotation speed difference between the first and the second flow-uniformization plates according to an electroplating thickness of a wafer.

6. The uniform flow control agitation device for electroplating according to claim 1, wherein the driving unit is a stepper motor with a driving output gear installed on its output shaft; and the driven assembly further includes a driving input gear set on the transmission shaft, with the driving output gear meshing with the driving input gear.

7. The uniform flow control agitation device for electroplating according to claim 1, wherein the driving unit source comprises a first driving source and a second driving source, which respectively rotate the first and second flow-uniformization plates.

8. The uniform flow control agitation device for electroplating according to claim 1, wherein the first flow-uniformization plate is provided with multiple flow-guiding regions, each flow-guiding region has one or more flow-guiding openings in its length direction, and both sides of each flow-guiding region extend upward to form a first flow-guiding wall and a second flow-guiding wall.

9. The uniform flow control agitation device for electroplating according to claim 8, wherein a height of the first flow-guiding wall and the second flow-guiding wall ranges from 6 mm to 8 mm.

10. The uniform flow control agitation device for electroplating according to claim 8, wherein the first flow-guiding wall and the second flow-guiding wall are inclined.

11. The uniform flow control agitation device for electroplating according to claim 10, wherein an angle between the first flow-guiding wall and the second flow-guiding wall is between 38° and 42°.

12. The uniform flow control agitation device for electroplating according to claim 1, wherein the second flow-uniformization plate is provided multiple radially distributed flow-guiding openings.

13. The uniform flow control agitation device for electroplating according to claim 1, wherein the first flow-uniformization plate and the second flow-uniformization plate have a circular shape, and their rotation centers are located on a vertical axis.

* * * * *